United States Patent [19]

Julian

[11] Patent Number: 5,042,342

[45] Date of Patent: Aug. 27, 1991

[54] FOOD PROCESSING APPARATUS

[75] Inventor: John C. Julian, Richland, Wash.

[73] Assignee: Lamb-Weston, Inc., Tri-Cities, Wash.

[21] Appl. No.: 408,738

[22] Filed: Sep. 18, 1989

Related U.S. Application Data

[63] Continuation-in-part of Ser. No. 119,662, Nov. 12, 1987, Pat. No. 4,979,418, and a continuation-in-part of Ser. No. 292,926, Jan. 3, 1989, Pat. No. 4,926,726, which is a continuation-in-part of Ser. No. 119,662, Nov. 12, 1987, Pat. No. 4,979,418.

[51] Int. Cl.[5] ..... B26D 3/11

[52] U.S. Cl. ..... 83/98; 83/402; 83/409.2

[58] Field of Search ..... 83/409.2, 402, 863, 83/865, 98

[56] References Cited

U.S. PATENT DOCUMENTS

| | | | |
|---|---|---|---|
| 3,108,625 | 10/1963 | Lamb et al. | 146/162 |
| 3,361,173 | 1/1968 | Lamb | 83/98 |
| 4,082,024 | 4/1978 | Hodges et al. | 83/402 |
| 4,251,555 | 2/1981 | Kroenig | 426/231 |
| 4,538,491 | 9/1985 | Henneuse | 83/402 |
| 4,644,838 | 2/1987 | Samson et al. | 83/865 |
| 4,704,959 | 11/1987 | Scallen | 99/538 |
| 4,807,503 | 2/1989 | Mendenhall | 83/22 |

*Primary Examiner*—Douglas D. Watts
*Assistant Examiner*—John M. Husar
*Attorney, Agent, or Firm*—Klarquist, Sparkman, Campbell, Leigh & Whinston

[57] ABSTRACT

The present invention discloses an apparatus for slicing a food product such as a potato into helical strips such as curlicue potato fries. The potatoes are pumped with water by a centrifugal food pump to a tapered elastic tubular delivery tube. The tube expands as the potato progresses along the tube. The delivery tube allows the potato to be gently forced against a circular rotating cutting head assembly. The cutting head assembly cores the potato, scores concentric cuts and then slices the potato to produce helical cut segments.

29 Claims, 10 Drawing Sheets

FIG. 14
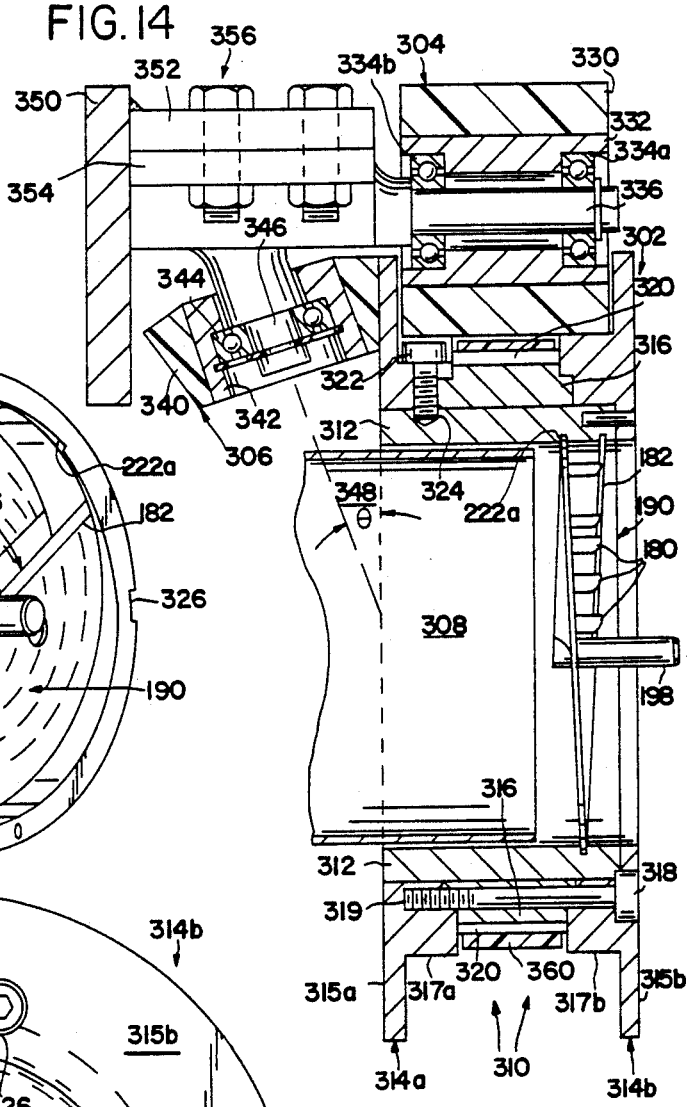
FIG. 15
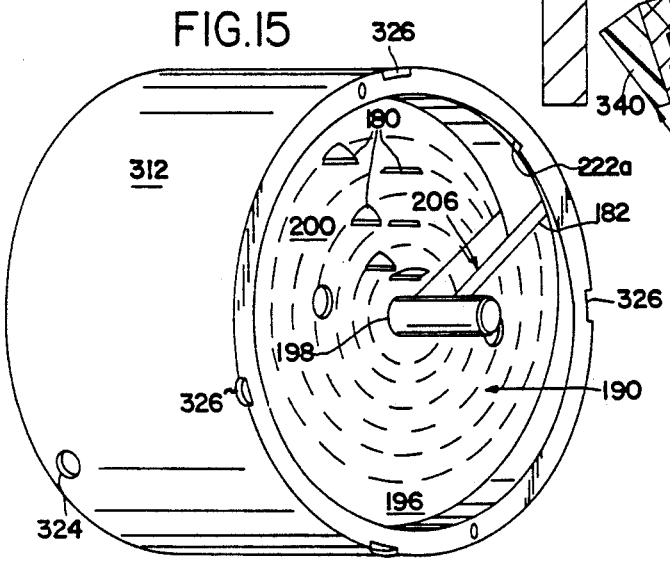
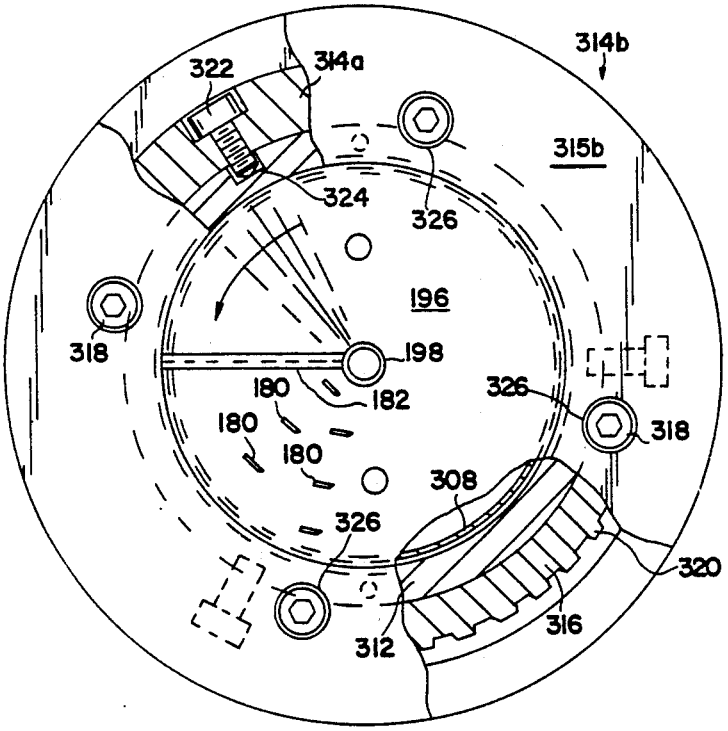
FIG. 16

FOOD PROCESSING APPARATUS

This is a continuation-in-part of application Ser. No. 07/119,662, filed Nov. 12, 1987, now U.S. Pat. No. 4,979,418 and a continuation-in-part of application Ser. No. 07/292,926, filed Jan. 3, 1989, now U.S. Pat. No. 4,926,726 which was a continuation-in-part of application Ser. No. 07/119,662, filed Nov. 12, 1987, now U.S. Pat. No. 4,979,418.

FIELD OF THE INVENTION

The present invention relates to food processing and more particularly to a method and apparatus for cutting a food item such as a potato into helical strips.

BACKGROUND OF THE INVENTION

Helical french fries or curlicue fries as they are more commonly known, have long been a popular food item. Apparatus suitable for making strips for curlicue french fries have been known for decades. Earlier devices were usually manually driven. Later devices used simple mechanisms to rotate the potato against a cutter head. Large commercial applications required that the cutting element be rotated and brought into engagement with the non-rotating potato. A typical problem with early designs was the fact that it was difficult to release the holding mechanism for insertion of the next potato.

One proposed solution to this problem is shown in U.S. Pat. No. 4,644,838 to Samson et al. and involves the use of a plurality of spring loaded fingers which protrude into the wall of a feed chute supplying potatoes to the cutting element and which act to restrain the potatoes therein against rotation. A reciprocating plunger pushes potatoes through the chute. Such an arrangement, however, limits the speed with which the apparatus can process potatoes, since approximately half of the plunger's motion is wasted. The plunger itself contributes to the complexity of this system since its periphery must be configured with grooves to permit the plunger to pass by the fingers in the chute without pushing the fingers to their retracted position.

This feed problem was overcome by food processing apparatus disclosed in co-pending patent application Ser. No. 07/119,662, filed on Nov. 12, 1987 now U.S. Pat. No. 4,979,418 and co-pending patent application Ser. No. 07/292,926, now U.S. Pat. No. 4,926,726 filed Jan. 3, 1989 both assigned to the assignee of the present application. Such applications disclose apparatus having a feed mechanism utilizing a series of rollers including at least one pair of spiked rollers. The rollers continuously feed potatoes into engagement with a rotating cutting head without wasted motion due to reciprocating elements. The cutting head of the '662 application is rigidly mounted and rotatably driven by a gear drive system. The cutting head of the '926 application is supported by idler rollers in free floating fashion and rotatably driven by a drive belt.

Although a significant improvement over the prior art, some problems were still encountered. One problem was that on occasion the entire potato was not cut. A butt end sometimes was left because the rollers could not engage the end portion of the potato being cut. Also, on occasion the potato was not perfectly centered when it entered the cutting head or exhibited a gouged surface due to slipping contact with the spiked rollers, resulting in helical strips having less than optimum thickness or uniformity.

The present invention overcomes the above-noted drawbacks and provides a simple apparatus for processing large numbers of potatoes into helical strips quickly and efficiently.

An object of the present invention therefore is to provide a cutting apparatus for use in food processing machines that is simple and efficient.

Another object is to provide a cutting apparatus that is easy and economical to manufacture.

Still another object is to provide a cutting apparatus with a minimum number of components, each of which is easily and quickly removed.

Another object is to provide a cutting apparatus that minimizes the accumulation of food pieces within the cutter head assembly.

Yet another object is to provide a cutting apparatus that improves the yield obtained from raw product as well as the quality and structural integrity of the helical strips produced during cutting.

A further object is to provide a cutting apparatus that reduces the number of butt pieces produced during cutting.

Another object is to provide a cutting apparatus that is better suited for processing smaller potatoes.

Yet another object is to provide a cutting apparatus with improved centering capability.

A further object is to provide a cutting apparatus that minimizes damage to the surface of the potato prior to cutting.

These and other objects, features, and advantages of the present invention will be more readily apparent from the following summary and detailed description which proceeds with reference to the accompanying drawings.

SUMMARY OF THE INVENTION

In the apparatus of the invention, potatoes are fed into a water containing supply tank. A radial impeller type food pump draws the water and potatoes from the supply tank and forces the water and the potatoes into a transfer tube. The transfer tube conveys the water and potatoes to a tapered reducer tube. The outlet of the tapered reducer tube is attached to a tapered elastomeric sleeve. The elastomeric sleeve has an inlet opening greater in diameter than the diameter of the largest potato. The elastomeric sleeve tapers to a diameter at its exit end which is smaller than the diameter of the entrance end. The outlet of the tapered elastomeric tube is mounted so that its center line is aligned axially with the center line of a rotating cutting member. The cutting member comprises a helical shaped knife defining a radially extending slicing blade at a leading edge thereof and supporting a plurality of perpendicularly extending scoring blades. The rotary cutting assembly is adapted to be gear driven by a motor. A stationary discharge tube is mounted on the outlet side of the rotary cutting assembly to receive and discharge the sliced potato pieces. This discharge tube prevents the potato pieces from accumulating and possibly disintegrating inside the rotary cutting assembly.

The potatoes are transported through the transport tube at a velocity equal to or less than the velocity of the water flow. The water pressure and flow force the entire potato, including any butt end, through the cutting member. Means are provided to quickly remove the cutting member to clear any obstruction or replace any damaged or dull knife blades.

BRIEF DESCRIPTION OF THE DRAWINGS

FIG. 14 is an enlarged sectional view taken substantially along line 14—14 of FIG. 13 illustrating a portion of the mounting arrangement for the cutter head assembly.

FIG. 15 is a perspective view of a sleeve insert of the second embodiment.

FIG. 16 is a plan view, partly in section, of the cutter head assembly of the second embodiment.

DETAILED DESCRIPTION OF THE FIRST EMBODIMENT SHOWN IN FIGS. 1-11

The apparatus of the invention is adaptable for cutting various bulbous vegetables into helical strips. The illustrated apparatus is particularly adapted to the cutting of potatoes into helical strips, and the apparatus will be described as it is applied to the cutting of potatoes and particularly to potatoes such as the Russett Burbank variety having a long axis and an elliptical cross section.

Figure 1:
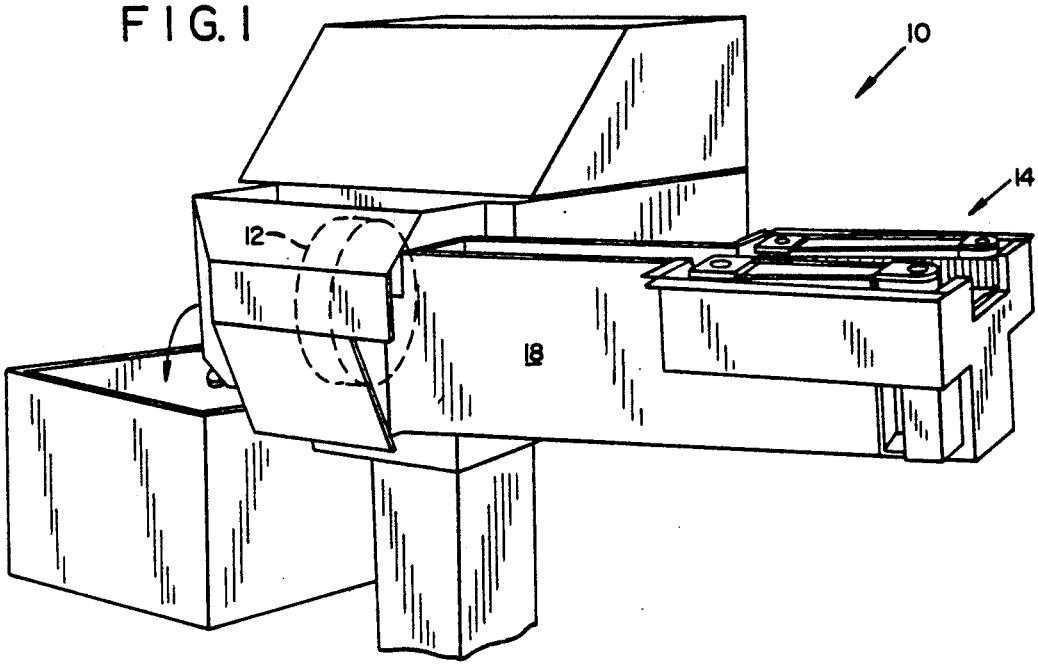
FIG. 1 is a perspective view of a food processing apparatus according to a first and second embodiment of the present invention.
Figure 2:
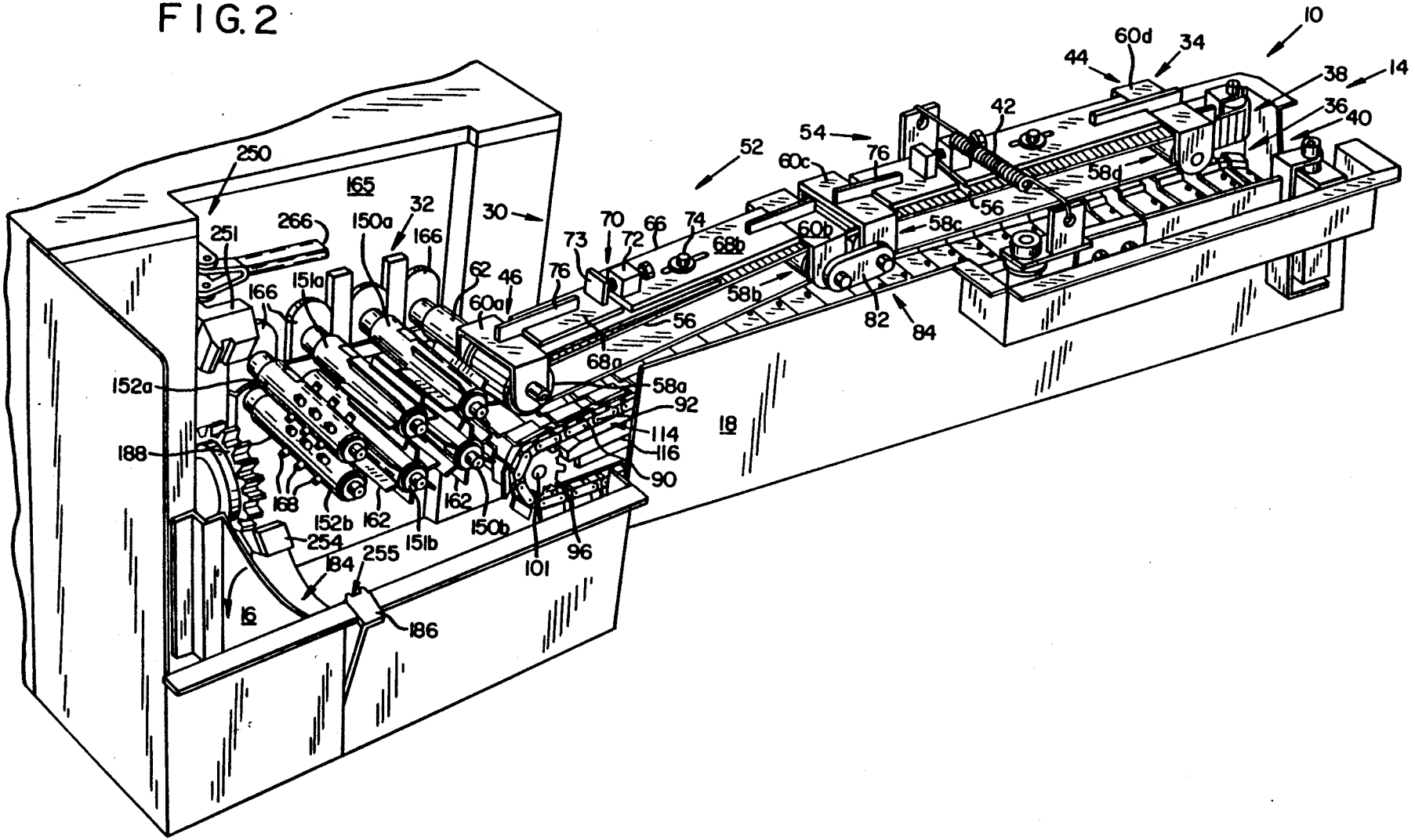
FIG. 2 is an enlarged fragmentary perspective view of the apparatus of FIG. 1 with the cutting assembly removed.
Figure 3:
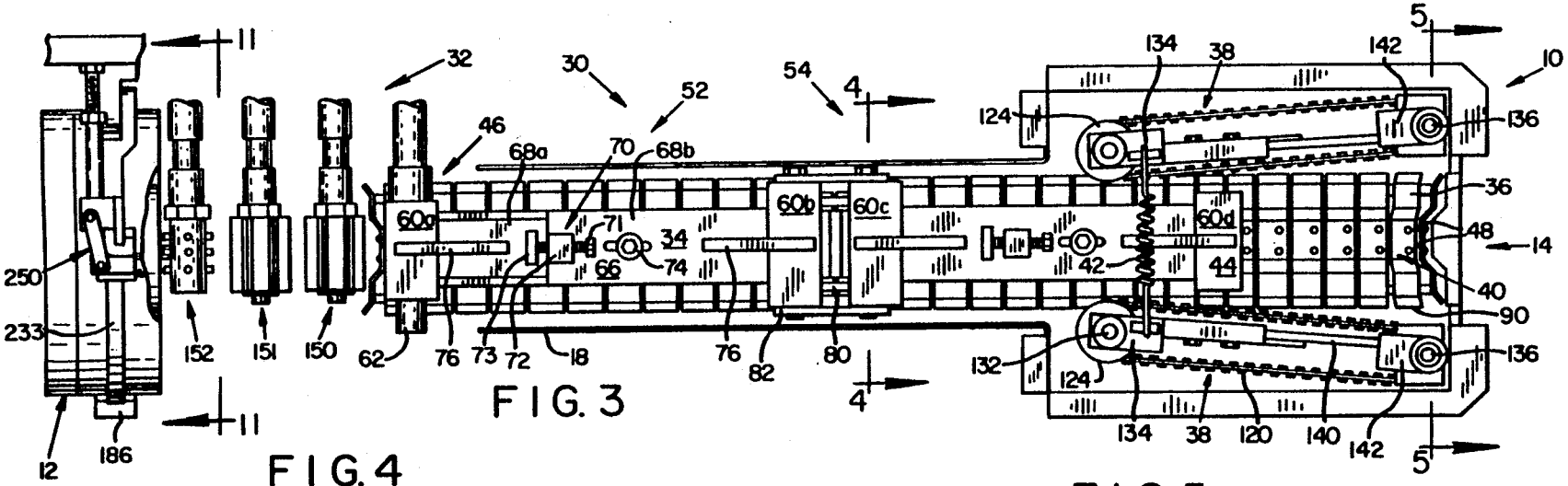
FIG. 3 is a fragmentary top plan view of the apparatus of FIG. 2.

With reference to FIGS. 1 and 2, a food processing apparatus 10 according to the illustrated embodiment of the invention comprises a rotary cutting assembly 12 into which potatoes are fed by a feed system 14. The potatoes are provided one by one to the feed system 14 from a conventional trough shaker or other singulator device (not shown) capable of feeding potatoes one by one in slightly spaced relation. Helical potato strips cut by the rotary cutting assembly 12 fall into a collection bin 16. The entire apparatus is enclosed in a stainless steel housing 18 for safety.

Referring more particularly to FIGS. 2-5, feed system 14 includes two principle sections: a conveyor section 30 and a feed roller section 32. Conveyor section 30 includes top, bottom and opposite side conveyors 34, 36 and 38, respectively. Potatoes provided to feed system 14 are initially placed on bottom conveyor 36 at an entry position 40, between side conveyors 38. The side conveyors 38 are biased toward each other at their discharge ends by a spring 42 (FIG. 2) and act to center the potato on the lower conveyor 36. Soon after a potato is positioned at entry position 40, it is carried beneath a first or forward end 44 of the top conveyor 34.

The top conveyor 34 is pivotally mounted at its second or discharge end 46 so that the forward end 44 can rise and allow potatoes of various sizes to pass thereunder. The weight of top conveyor 34 on the entering potatoes causes the potatoes to become impaled on dogs 48 spaced periodically along the lower conveyor's length. The top conveyor 34 includes two hingedly connected sections 52, 54. The section 52 comprises a rubber belt 56 lugged on its outer surface and trained over a pair of rollers **58*a* and 58*b*. Roller 58*a* is mounted on a drive shaft 62 to which a yoke 60*a* is pivotally mounted. Roller 58*b* is rotatably mounted in a second yoke 60*b*. The yokes 60*a*, 60*b* are mounted to the opposite ends of an expandable frame 66 which permits adjusting the tension of belt 56. The expandable frame 66 comprises two slidably engaging members 68*a*, 68*b* linked together by a tensioning device 70 comprising a bolt 71 threaded through a mount 72 on the frame member 68*b* and engaging a stop 73 on the frame member 68*a*. When the bolt 71 is extended out of the mount 72 toward the stop 73, the frame 66 is extended. A locking bolt 74 is provided to lock the members 68*a*, 68*b* in position. Ribs 76 extend from yokes 60 along the frame members 68*a*, 68*b*** to improve the structural rigidity thereof.

The second section of top conveyor section 54 is similar in construction to the first section 52 and comprises a belt 56 trained over rollers **58*c*, 58*d* mounted in yokes 60*c*, 60*d*, respectively, which are mounted to the opposite ends of an expandable frame 66. The first and second conveyor sections 52, 54 are tied together by oppositely positioned tie straps 82 in which the shafts for the rollers 58*b*, 58*c* are carried. The tie straps 82 cooperate with yokes 60*b*, 60*c* to form an articulated joint 84 that allows first section 54 of top conveyor 34 to move substantially independently of second section 52 and facilitates vertical movement of the top conveyor to accommodate passage of potatoes thereunder. The second section 54 is driven from first section 52 by two drive belts 80 trained over the rollers 58*b* of section 52 and 58*c* of section 54, the ends of the rollers being provided with grooves to receive the belts 80 (see FIG. 4**).

The bottom conveyor 36 (FIGS. 2-5) comprises a plurality of metal pans 90 linked pivotally to one another and welded at each side to links of one of a pair of drive chains 92. Each pan 90 is provided with an upstanding flange 94 along each side edge to prevent a potato from bouncing out of the pan as it is fed therein. Adjacent the flanges 94 are opposite flat portions, the center of a pan having a center trough depression 95 defined by sloping side walls 97 and a flat bottom 98 which carries the dogs 48. The potatoes will tend to be carried lengthwise in the trough 95 as indicated in FIG. 5 wherein a potato 99 is shown in dotted lines.

Figure 5:
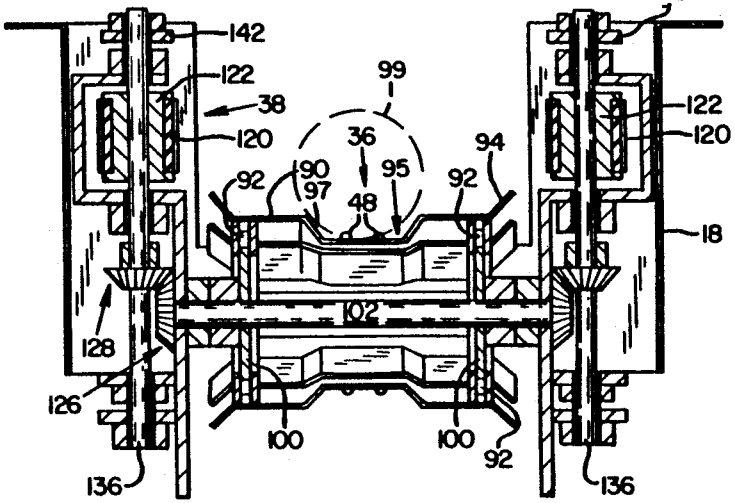
FIG. 5 is an enlarged sectional view taken on line 5—5 of FIG. 3.
Figure 4:
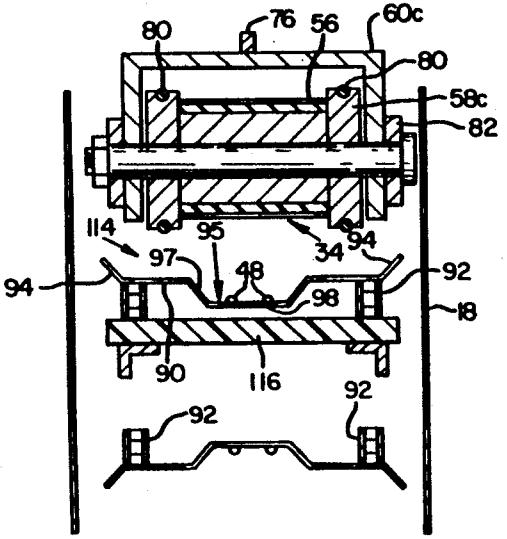
FIG. 4 is an enlarged sectional view taken on line 4—4 of FIG. 3 showing a portion of the conveyor section of the feed assembly.

The drive chains 92 are driven by drive sprockets 96 mounted on a drive shaft 101 and are carried by sprockets 100 on a distal shaft 102 at the infeed end of the conveyor (see FIG. 5). The drive shafts 62, 101 for the upper and lower conveyors 34, 36 are mounted and driven by an arrangement similar to the mounting shafts 70 of the Green Corn Cutting Machine shown in U.S. Pat. No. 2,787,273, which arrangement permits their movement toward and away from one another to accommodate the passage of potatoes therebetween. A support member 116 formed of low friction plastic is disposed beneath the upper run 114 of the conveyor 36 for substantially its entire length to prevent the conveyor from deforming under the combined weight of potatoes and the upper conveyor.

The side conveyors 38 are positioned adjacent the entrance end of the conveyor section 30 to assure centering of the potatoes on the lower conveyor 36 as they are fed from the trough shaker onto the conveyor section. The side conveyors 38 are similar and each comprises a rubber belt 120 lugged on both surfaces and carried by correspondingly lugged rollers 122, 124. The rollers 122 are fixed to vertical shafts 136 and driven through pinion gears 126, 128 from the shaft 102 which is driven by the bottom conveyor 36 (see FIG. 5). The rollers 124 are rotatably mounted on shafts 132 carried by yokes 134 supported on the free end of the internal frame 140, the opposite end of which is fixed to yokes 142 pivotally mounted on the respective drive shaft 136. The side conveyors 38 are urged toward one another by a tension spring 48 connected to yokes 134.

Figure 10:
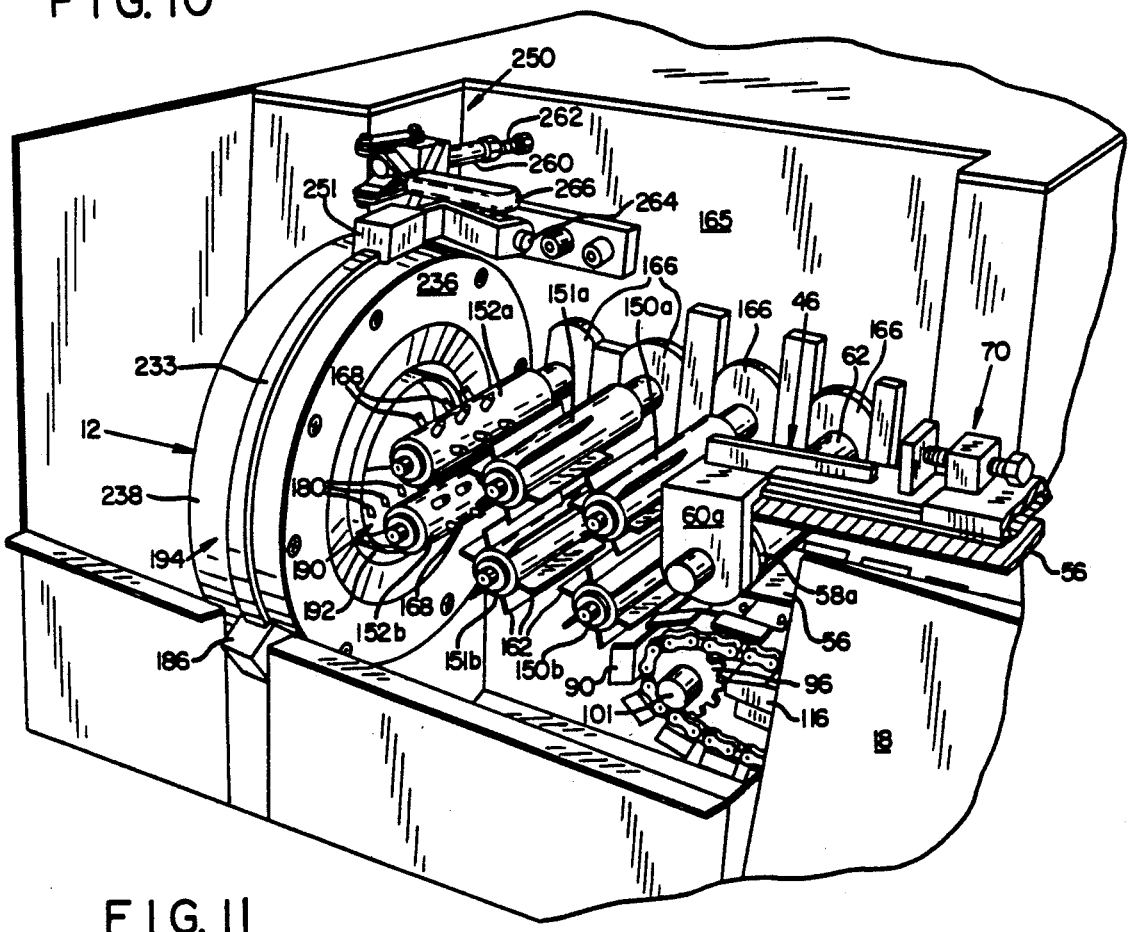
FIG. 10 is an enlarged fragmentary perspective view of the apparatus of FIG. 1 showing the rotary cutting assembly mounting arrangement and the relationship between the rotary cutting assembly and the feed rollers.

As a potato leaves the conveyor section 30, it passes between three pairs of feed rollers 150, 151, 152 (FIGS. 2, 3 and 10) that advance the potato into the rotary cutting assembly 12 while preventing it from rotating. These rollers are mounted and driven in a manner similar to that shown in U.S. Pat. No. 2,787,273 for the feed rollers 60, 62, 64 thereof. Thus, the upper and lower feed rollers of each pair 150, 151 and 152 are secured to upper and lower shafts 153 and 155, respectively (FIG. 11), there being one such pair of shafts for each pair of rollers. Each shaft 153 and 155 is connected through a universal joint 156 to a worm gear 157 which is enmeshed with a driving worm 158 on a main driving shaft 159. One such driving worm is provided for each pair of shafts 153 and 155, the worm gears 157 of which engage the driving worm at opposite sides so that the two shafts 153, 155 of each pair rotate in opposite directions. Hence, the feed rollers 150, 151 and 152 cooperate with each other to advance the potatoes successively from the conveyor section 30 to the rotary cutting assembly 12.

Each of the three pairs of feed rollers 150, 151 and 152 is provided with means for resiliently pressing the respectively associated upper and lower rollers toward each other. Each pair of rollers is likewise provided with means interconnecting the associated upper and lower rollers for assuring equalized, opposite movement. Since these means employed for each pair of rollers are identical with those employed for each of the other pairs, a description of the pressing means and the equalizing means for one pair of rollers will suffice. For example, the shafts 153 and 155 of the third pair of feed rollers 152 (FIG. 11) are rotatable in upper and lower bearing blocks 160 and 161 respectively, which are guided and restricted to vertical sliding movement in channels 163 and 164 in a housing 165. Debris seals 166 slide with shafts 153, 155 and prevent debris from entering the roller positioning mechanism inside the housing 165. Upper and lower equalizing arms 167 and 169 are pivoted, respectively, on shafts 171 and 173 which are rigidly mounted on a frame 175. The outer ends of the arms 167 and 169 bear against the bearing blocks 160 and 161 toward each other by force derived from biasing springs 176 and 177. The biasing springs 176, 177 encircle a tensioning rod 178 and are each compressed between one of the equalizing arms and a nut 179 on the associated end portion of the rod. Accordingly, the springs 176 and 177 continuously urge the feed rollers **152*a*, 152*b*** toward each other to effect engagement of the same with a potato with pressure adequate to ensure advance of the potato in response to rotation of the rollers and to prevent the potato from rotating.

The mechanism that interconnects the feed rollers **152*a* and 152*b* for equalized movement in opposite directions includes arms 181 and 183 extending toward each other from the upper and lower shafts 153 and 155, respectively. These two arms 181 and 183 are interengaged by a tooth and notch arrangement 185 whereby rotary motion of the one about the axis of its supporting shaft effects simultaneous and corresponding rotary motion of the other about the axis of its supporting shaft. Whereas the lower arm 183 is integral with the lower equalizing arm 169, the upper arm 181 is mounted pivotally on the shaft 171 independently of the upper equalizing arm and is adjustably connected thereto by a lever 187. The lever 187 is integral with the arm 181 and extends upwardly from the shaft 171 where it is engaged between opposed adjusting screws 189 carried by a lever 191 integral with the upper equalizing arm 167. By manipulation of the adjusting screws 189, the angular position of the upper equalizing arm relative to the lever 191 can be adjusted, and consequently the two feed rollers 152*a*, 152*b*** can be adjusted to positions wherein they are equidistant from the horizontal axis of rotation of the cutting element.

Since all of the upper feed rollers **150*a*, 151*a* and 152*a* are rotated in one direction while all of the lower feed rollers 150*b*, 151*b* and 152*b* are rotated in the opposite direction, a potato delivered to the first pair of rollers 150 will be advanced thereby to the second pair 151, which will pass the potato to the third pair of rollers 152, which in turn will advance the potato into the rotary cutting assembly 12**.

Since the equalizer arms 167 and 169 associated with each pair of feed rollers are interconnected as above described, the rollers of each pair will be thrust apart by each potato as the potato enters between the two opposed rollers, the amount of such yielding movement depending upon the diameter of the potato. Furthermore, the opposite rollers of each pair will always be disposed at equal distances above and below the axis of rotation of the rotary cutting element so that each potato during its travel through the machine is maintained in coaxial alignment with the rotary cutting assembly 12.

The feed rollers 150 and 151 are provided with metal fins or paddles 162 (FIG. 10) which positively engage a potato without damaging its exterior. The feed rollers 152 immediately adjacent rotary cutting assembly 12, however, are provided with pins 168 which more positively engage the surface of a potato to prevent its rotation after it is engaged with the cutting assembly and more positively feed the potato into the cutter knife. Since the spiked rollers 152 provide the last positive control over the potato as it enters the rotary cutting assembly 12, it is desirable that these rollers be as close to this cutting assembly as possible (a spacing of 0.75 inches has been found satisfactory) and that the rollers be able to grip even the small butt end of a potato. To this end, bearing blocks 160 and 161 for upper and lower shafts 153 and 155 are sized so that the nominal distance between rollers 152 is smaller than the distance separating the other pairs of rollers 150 and 151. This permits the rollers 152 to exert good control over a potato even when gripped from at its butt end.

Figure 6:
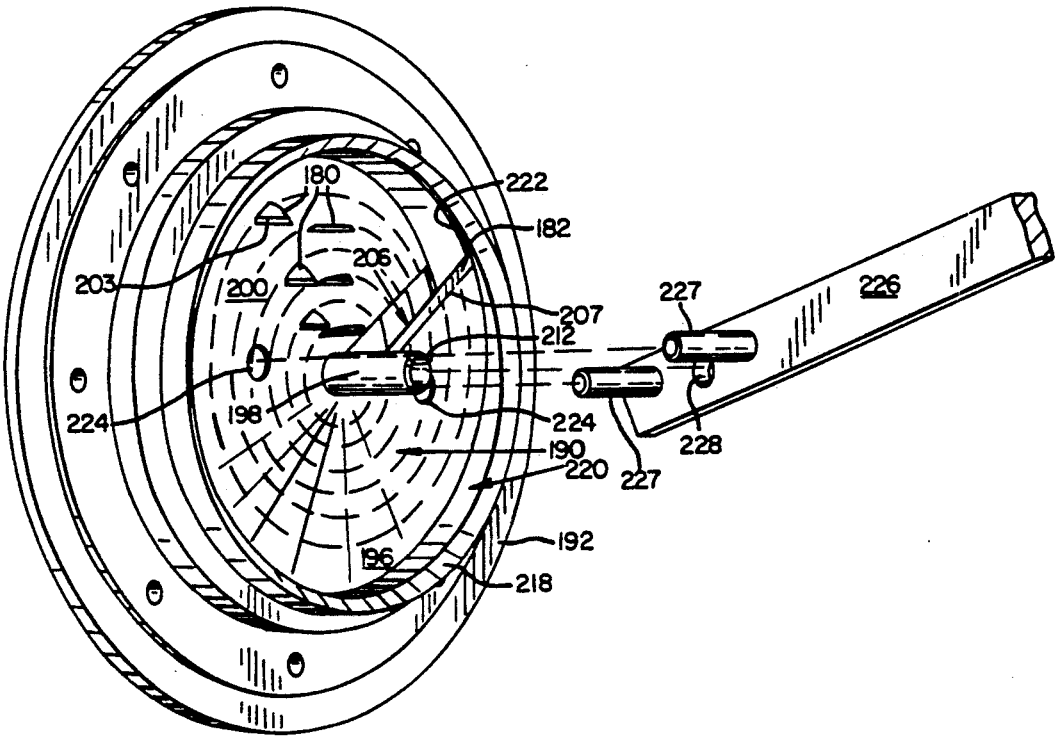
FIG. 6 is a perspective exploded view of a cutting element and associated holder used in the apparatus of the invention and a tool for inserting and removing the cutter from the holder.

The rotary cutting assembly 12 cuts the potatoes advanced through it into helical strips by action of a plurality of concentrically spaced scoring blades or knives 180 and a slicing blade 182 (FIG. 6). Rotary cutting assembly 12 rests in a cradle 184 defined by a guide 186 (compare FIGS. 2 and 10) and is driven by a drive gear 188 powered by an electric motor (not shown).

Referring now to FIGS. 6–9, the rotary cutting assembly 12 includes a cutting element 190, a ring-like holder 192 for mounting the cutting element at its periphery and a housing 194 within which the holder/cutting element combination can rotate. Cutting element 190 principally comprises a helically shaped plate 196 welded about a central tube 198. On a front surface 200 of the plate 196 are welded the scoring knives or blades 180 which are spaced apart radially from the central tube 198 and extend substantially parallel thereto for concentrically scoring a potato as it is advanced towards the front surface. The blades 180 are desirably disposed on the plate 196 in an alternating, staggered arrangement defining at least two radially extending rows. This arrangement minimizes frictional engagement between the potato and the blades by reducing the compression of the potato in the regions being cut. The blades 180 are bevelled on their outer sides 202 (FIG. 7) to form cutting edges 203 on their outer leading edges, the compression stress induced in the potato by the penetration of the blades 180 being relieved by expansion of the potato towards its periphery.

The plate 196 has a leading edge portion 204 (FIG. 6) defining the radially extending slicing blade 182 that slices the face of a potato scored by the scoring blades 180. The leading edge portion 204 is bent or inclined approximately three degrees relative to the projected surface of the plate 196 in a direction away from its trailing edge 205 (that is, in the direction towards an advancing potato) for a width of about 0.3 inches, as shown by the bend line 207 in FIG. 7. This arrangement has been found to aid in drawing the potato into and through the cutting assembly. The slicing blade 206 is bevelled on its rear surface 208 opposite front surface 200 to form a knife edge 209 to enhance this effect (see FIG. 8).

The central tube 198 (FIG. 9) terminates in a plane perpendicular to its axis and is bevelled at a front end 210 thereof to define a cutting edge 212 along its inner periphery. The cutting edge 212 cuts cores from potatoes advancing into the rotary cutting assembly 12, which cores then pass through tube 198 to the collection bin 16 (FIG. 2). The front end 210 of tube 198 is desirably swaged in so that the cutting edge 212 defines a cutting diameter less than the nominal inside diameter of the tube 198 so the cores cut by the cutting edge may more easily slide through the tube to the collection bin.

Figure 9:
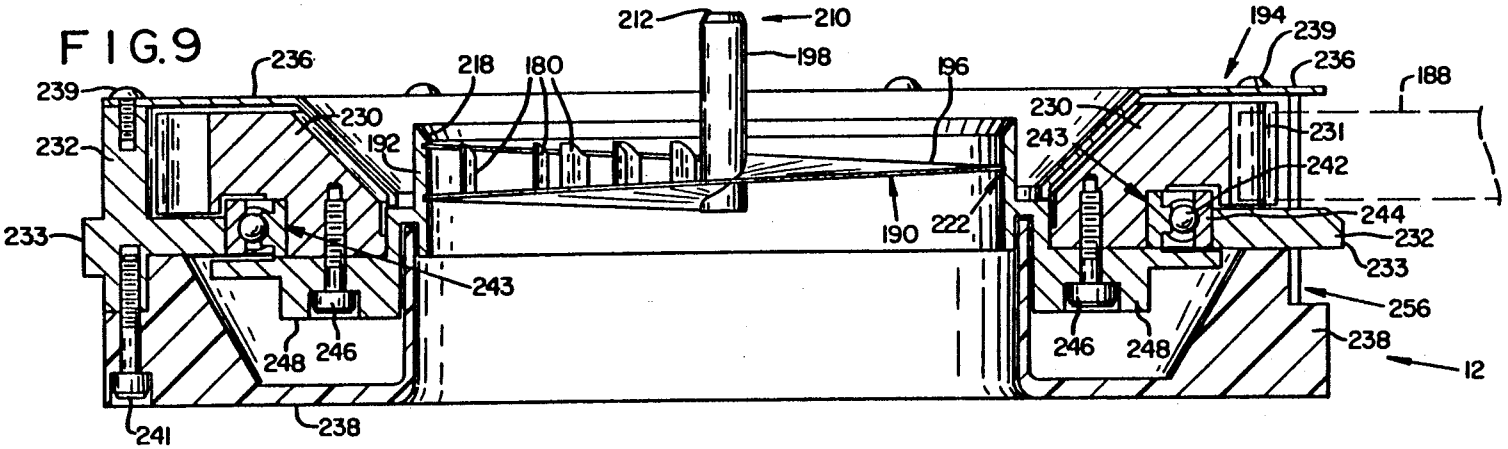
FIG. 9 is a sectional view of a rotary cutting assembly used in the first and third embodiment of the invention.
Figure 7:
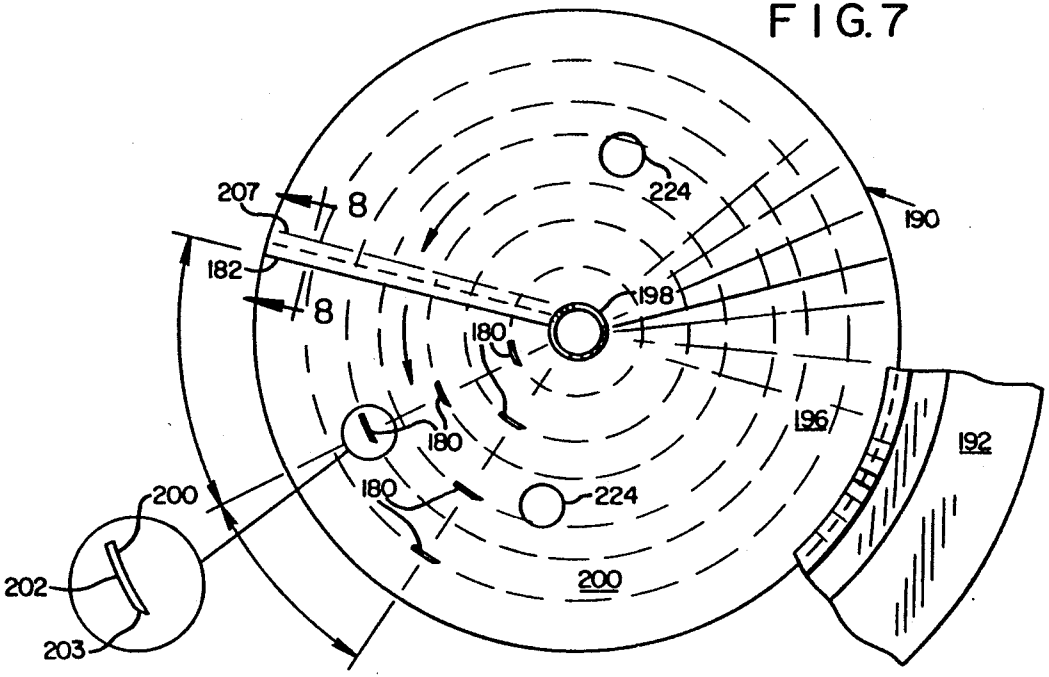
FIG. 7 is a plan view of the cutting element of FIG. 6 showing in dashed lines the concentric paths of the scoring knives and showing a fragmentary portion of the holder for the cutting element.

Referring now to FIGS. 6 and 9, the leading edge of the cutting element holder 192 is formed with a bevel 218. The inner peripheral surface 220 of the holder 192 is formed with a helical groove 222 that begins at the bevel 218 and which corresponds to the pitch of the helical plate 196 at its periphery so that the plate can be threadedly received by the holder 192. The threading of plate 196 into and out of the holder 192 is facilitated by providing at least one hole 224 in the plate spaced radially from its center. A tool 226 having a suitable projecting pin 227 and a hole 228, such as are shown in FIG. 6, can then be engaged in hole 224 and with the hole in tube 198 to enable application of a torque to the plate 196 by which it can be threaded into or out of the holder 192. The groove 222 into which the helical plate 196 threads is just slightly longer than one full turn so that the plate 196, when fully threaded in, is locked against further rotation relative to the holder.

The holder 192 and the cutting element 190 are rotatably mounted in the rotary cutting assembly 12 (FIG. 9) which includes a housing 194 including a front guard portion 236 and a rear guard portion 238 between which is mounted a frame ring 232 by screws 239, 241.

The housing 194 is fixedly mounted in the apparatus by means to be described while the holder and cutting element 190 rotate relative thereto. Secured to an outer flange 248 of the holder 192 by screws 246 is a drive ring 230 having gear teeth 231 formed on the periphery thereof. The ring 230 is provided with a circumferential groove 243 for receiving a sealed circular bearing 242, the outer race 244 of which engages the frame ring 232. The bearing 242 thus permits relative rotational movement between the drive ring 230 and the frame ring 232. The toothed drive ring 230 is rotatably driven by the drive gear 188 (FIGS. 2, 11) when the rotary cutting assembly 12 is positioned in the cradle 184. The rotational movement of the drive ring 230 is transmitted to the holder 192, and thus to the cutting element 190. The frame ring has a peripheral protrusion 233 thereon, the function of which will be described.

Figure 11:
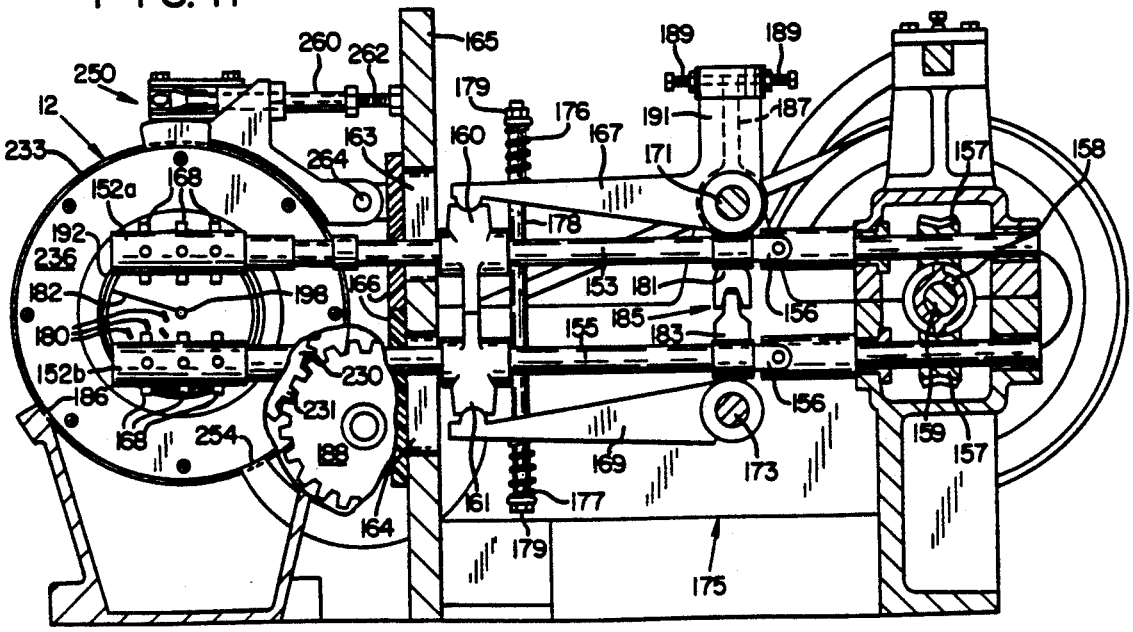
FIG. 11 is an enlarged fragmentary sectional view of the apparatus taken on line 11—11 of FIG. 3 illustrating the feed roller mechanism.

The rotary cutting assembly 12 is releasably secured to the frame of the apparatus 10 by an overcenter clamp assembly 250 (FIG. 10) which abuts the housing 165 and engages notched block 251 with the peripheral protrusion 233 on the frame ring 233. When in the position illustrated, a post 260 extends from clamp 250 and abuts the housing 165 through a bolt 262, thereby urging the block 251 downwardly onto the assembly 12 about a pivot point 264. When a handle 266 of clamp 250 is pulled forward, post 260 is retracted from its abutment with the housing 165, permitting block 251 to swing upwardly about the pivot 264 to release assembly 12. The protrusion 233 on assembly 12 that is engaged by the notched block 251 of clamp 250 also keys into a notch 255 in the guide seat 186 (FIGS. 2 and 10) to assure proper alignment of the assembly in the apparatus. As shown in FIG. 11, the drive gear 188 meshes with the gear teeth 231 on the drive ring when the assembly 12 is mounted in place. An orienting boss 254 in the cradle 184 engages a notch 256 (FIG. 9) in the frame ring 232 to prevent rotation of assembly 12 when drive gear 188 is operated.

Method of Operation—First Embodiment

In operation, the trough shaker or other singulator feeding food processing apparatus 10 provides potatoes to entry position 40 with their long axes aligned parallel to the top and bottom conveyors 34, 36. Preferably, the potatoes are provided seriatim, but at a rate slightly less than the advance rate of the conveyors so that they are spaced apart by a slight distance after they have been engaged by the conveyors. The orientation and spacing of the potatoes is maintained during their travel by the conveyors' and feed rollers' positive engagement mechanisms.

The peripheral speed of the feed rollers 150–152 is desirably slightly greater than the apparent advancing speed of the slicing blade 182. If the pitch of the slicing blade, or the speed at which it is rotated, is such that the advancing rate of the slicing blade 182 is faster than the advancing rate of the potato, a severe stress is introduced into the potato at the point at which it is being cut. This stress can break the resultant helical strips into non-continuous segments. This is avoided by the desired arrangement in that a potato will be firmly urged against the rotating cutting element 196, with the speed differential causing the potato to slip slightly on the spikes 168 on the feed rollers 152. The spacing between adjacent potatoes in the feed system permits this "overfeeding" of potatoes into the cutting element without resulting in a backing up of the incoming potatoes.

Figure 8:
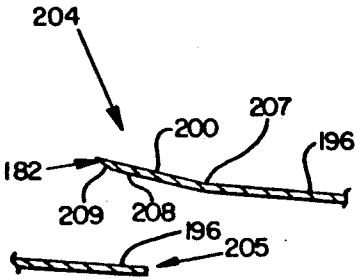
FIG. 8 is a sectional view taken on line 8—8 of FIG. 7 showing the inclined slicing edge portion of the cutting element.

As cutting element 190 rotates, each incoming potato is scored along concentric lines and sliced by slicing blade 182, producing helical or spiral potato strips of varying diameters. The thickness and width dimensions of the helical strips are dependent upon the radial spacing of the paths of rotation of scoring blades 180 (see FIG. 7) and the spacing between slicing blade 182 and trailing edge 205 (FIG. 8). After being cut, the helical potato strips are conveyed away from the rotary cutting apparatus for further processing.

Detailed Description of Second Embodiment Shown in FIGS. 12–16

An alternative embodiment of the invention is shown in FIGS. 12–16. This embodiment differs from the embodiment of FIGS. 1–11 primarily with respect to the cutter head assembly employed to support the cutting element and the mechanism employed to cause rotation of the cutter head assembly. Except where indicated, the two embodiments are otherwise identical. Identical parts in the second embodiment retain the same reference numerals.

Figure 12:
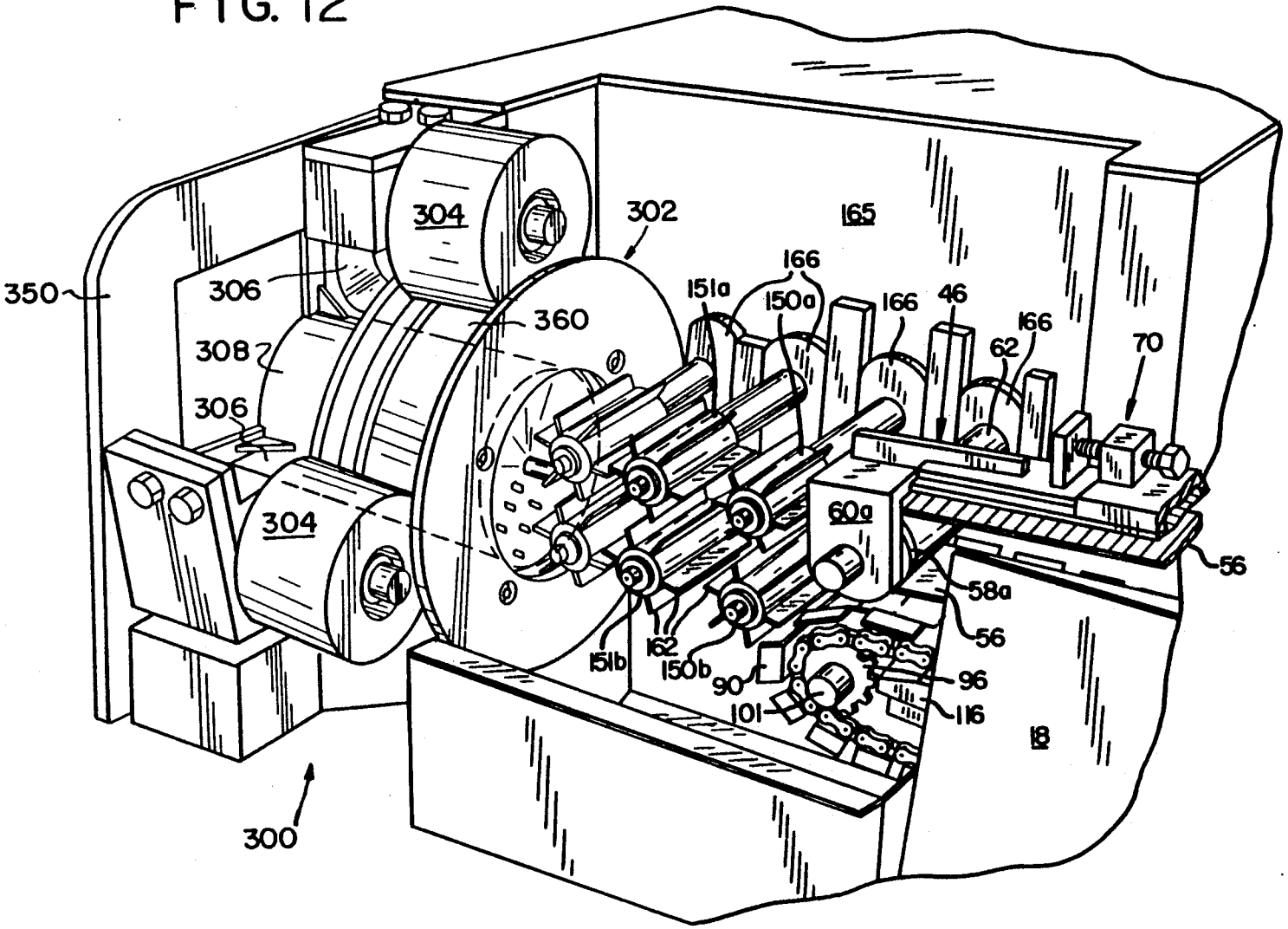
FIG. 12 is an enlarged fragmentary perspective view showing a second embodiment of the cutter head assembly and mounting arrangement for same, and their relationship with the feed assembly.
Figure 13:
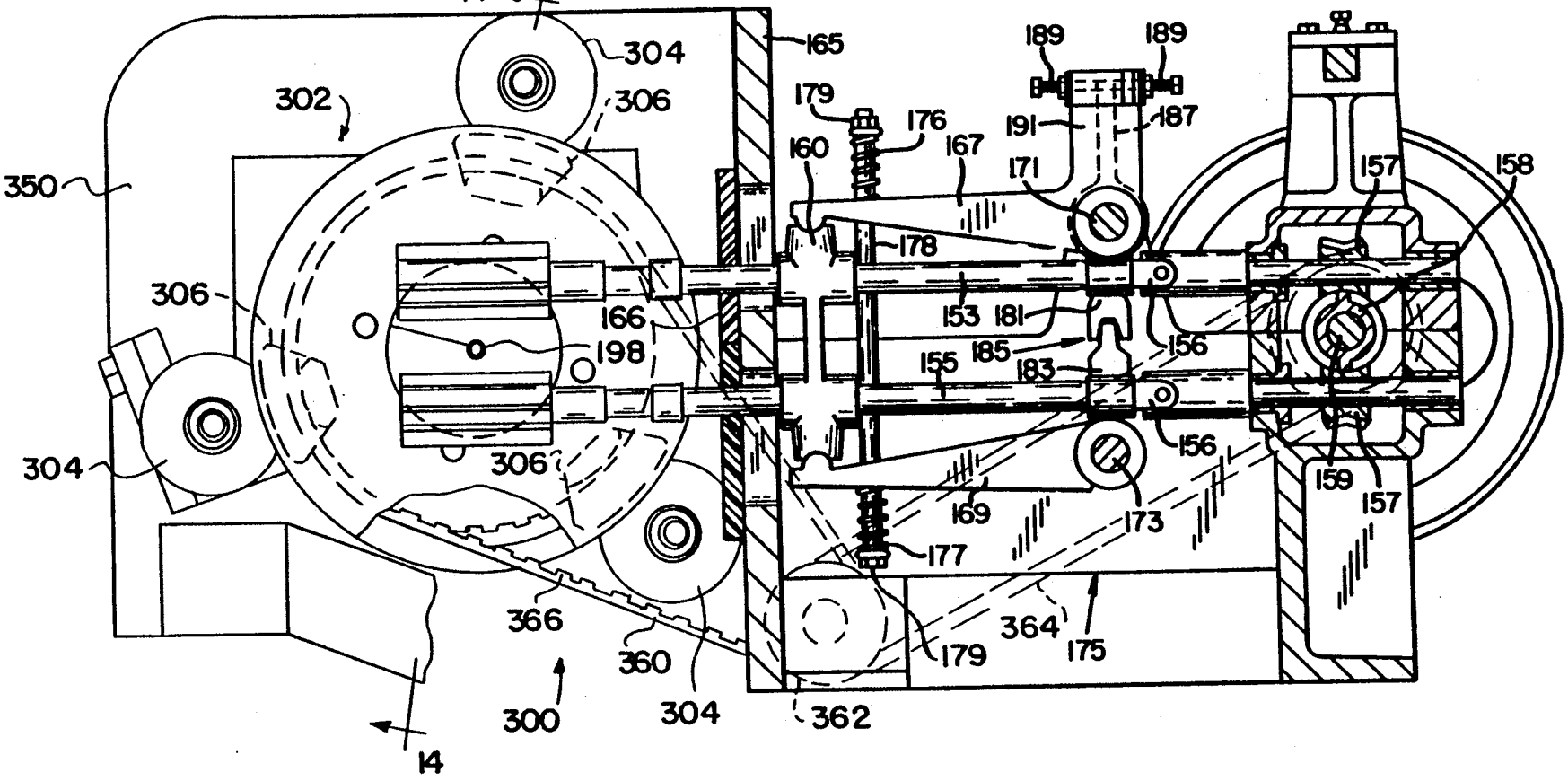
FIG. 13 is an enlarged fragmentary sectional view of the second embodiment showing the relationship between the cutter head assembly, mounting arrangement, and drive mechanism.

Referring to FIGS. 12 and 13, the alternative embodiment designated generally as 300, includes a rotatable floating cutter head assembly 302, cutter head support means for supporting the cutter head assembly, a stationary discharge tube 308, and drive means for causing the cutter head assembly to rotate about its longitudinal axis. Potatoes are fed axially by feed system 14 to cutter head assembly 302, where cutting element 190 (FIG. 15) engages and slices the potatoes into helical strips. The resulting helical strips enter into and are discharged through discharge tube 308.

Cutter head assembly 302, which is substantially cylindrical, has an outer periphery, an upstream cutting end facing feed system 14 and an opposite downstream discharge end proximate to where the helical strips are discharged. It includes a rotatable knife means such as cutting element 190 for slicing potatoes into helical strips, and a rotatable mounting structure for securely supporting the knife means and rotating the knife means about its longitudinal axis. More specifically, with reference to FIG. 14, the rotatable mounting structure includes a cylindrical outer jacket 310 and an inner cylindrical sleeve 312 which is removably mounted inside jacket 310. The jacket has an inner diameter just large enough to provide clearance for the outer diameter of sleeve 312.

As seen best in FIGS. 14 and 15, sleeve 312 has a substantially cylindrical configuration and serves primarily to mount cutting element 190. It has opposed inner and outer cylindrical surfaces, an upstream cutting end portion where potatoes are received from feed system 14 and an opposite downstream discharge end portion facing away from the feed system. A helical groove **222*a* (FIG. 15) of about one and one-half turns is machined in the inner surface of the sleeve at its cutting end portion to threadably receive cutting element 190. A plurality of half-moon shaped indentations or recesses 326 (FIG. 15) are machined or otherwise formed in an end surface of the sleeve's cutting end portion and are spaced equidistantly about the circumference of the end surface. Similarly, a plurality of circular indentations or recesses 324 (FIG. 15) are drilled or tapped partially into the outer surface of the sleeve near its discharge end. Recesses 324** are spaced equidistant from one another, and are circumferentially aligned.

Jacket 310 is formed essentially of three main components: a central belt-engaging member 316 and a pair of opposite annular outer members **314*a*, 314*b* which enclose central member 316. Outer member 314*a* is located proximate to the discharge end of the cutter head assembly while outer member 314*b* is located proximate the cutting end. Central member 316 has a configuration that includes opposite shoulder portions which mate with respective complementary shoulder portions of outer members 314*a*, 314*b***, thereby providing a nesting fit between the central member and adjacent outer members.

Jacket fastening means, shown in the illustrated embodiment as allen head connecting screws 318, are employed to fasten the central and outer members together as an integral unit. To assemble the jacket, allen head screws 318 are inserted through openings in an end face of outer member **314*b*, then through corresponding openings in central member 316, and finally are threadably received by respective seats 319 (one shown) in outer member 314*a*. As shown in FIG. 14, the screw openings in outer member 314*b* are enlarged at the end surface to permit the heads of screws 318** to lie flush with the end surface. The screws may be tightened or loosened in a conventional manner using an allen wrench.

Central member 316, which has a substantially cylindrical configuration, has a plurality of belt-engaging teeth 320 about its entire circumference to provide a complementary gripping surface for the driving means.

Outer members **314*a*, 314*b* essentially are mirror images of one another, except for the connecting screw and set screw allowances. At opposed end faces of the jacket, each outer member has a radially extending flange portion 315*a,b* (FIG. 15) and a flat interior shoulder portion 317*a,b* adjacent central member 316. The flange portions and shoulder portions of outer members 314***a*, 314*b*, together with central member 316, form a guide or track for the drive means.

As shown in FIGS. 14 and 16, flange portion 315*b* is part of an end face having a radially inwardly extending lip. This lip acts as an abutment or stop means for sleeve 312 when the sleeve is mounted coaxially inside the jacket. The lip terminates at a circular infeed opening having the same diameter as the sleeve's inner diameter. The sleeve is securely mounted within the jacket, with the cutting end of the sleeve in abutment with the lip, by fastening means comprising set screws 322. Screws 322 are threaded through outer member 314*a* and extend into locking engagement with aligned recesses 324. This engagement of sleeve 312 by set screws 322 prevents both axial and rotational movement of sleeve 312 relative to jacket 310. Similarly, the heads of connecting screws 318 each have a portion thereof which engages complementary-shaped, aligned recess 326 so as to provide additional means to lock sleeve 312 and jacket 310 together and prevent relative rotation therebetween.

It will thus be apparent that the jacket, sleeve and cutter element rotate together about a common longitudinal axis aligned with the longitudinal axis of the potatoes fed to the cutting element by the feed system. The jacket, as described, serves as a support means for the sleeve and cutting element and as a means for imparting a rotational force to the cutting element.

Referring now to FIG. 14, the cutter head support means includes three idler support rollers 304 and three thrust support rollers 306. Idler rollers 304 ride on shoulders 317*a*, 317*b* in the track or guide created by outer members 314*a*, 314*b*. They serve primarily to support the cutter head assembly and prevent radial movement of the cutter head assembly as it rotates. Secondarily, the idler rollers serve somewhat to resist axial movement of the cutter head assembly by virtue of their radially overlapping relationship with flange portions 315*a*, 315*b* which are spaced closely on either side of the idler rollers. Each idler roller 304 has an outer urethane layer 330, an inner bearing-engaging race 332, a pair of single-row radial ball bearings 334*a*, 334*b*, and a bearing shaft 336 on which the bearings are mounted.

Thrust rollers 306 (FIGS. 13 and 14) supportingly engage the downstream discharge end surface of the jacket so as to counteract axial forces on the cutter element and cutter head assembly caused by potatoes being forced into the cutter element by feed system 14. The thrust rollers rollingly engage outer member 314*a* as it rotates to resist the pushing force exerted on the cutter head assembly by the potatoes being fed thereto. Thrust rollers 306 have an outer urethane layer 340, an inner, bearing-engaging race 342, a single-row radial ball bearing 344, and a bearing shaft 346 on which bearing 344 is mounted. The fore thickness of urethane layer 340 is smaller than its aft thickness such that the axis of the shaft 346 forms an acute angle "$\theta$" (FIG. 14) of preferably about 19 degrees with the radial plane of the cutter head assembly. The canted disposition of the thrust rollers is required because the angular velocity of the cutter head assembly increases as the distance from the center of its axis increases.

Each thrust roller 306 is mounted in close proximity to a corresponding idler roller 304. As seen best in FIG. 14, each idler roller and its corresponding thrust roller are mounted to a common support means. The support means includes a support bracket 352 which extends perpendicularly from frame 350, a bearing mounting member 354 from which shafts 336 and 346 integrally extend, and fastening means such as bolts 356 and associated nuts for fastening mounting member 354 to support bracket 352. This common support means permits each pair of idler and thrust rollers to be quickly and easily removed to enable access to and removal of the cutter head assembly 302.

Stationary discharge tube 308 is mounted coaxially inside sleeve 312 so that its leading upstream end is in close proximity to cutting element 190. Discharge tube 308 has an opposite downstream discharge end which extends outwardly of the discharge opening of the sleeve. The discharge tube is mounted by supporting brackets (unnumbered in FIG. 12) secured to frame 350. Helical potato strips emerging from the cutting element enter into the discharge tube, are pushed downstream by the following stream of sliced potatoes, and then are discharged out the discharge end. The stationary discharge tube buffers the sliced potato strips from the centrifugal force acting on the sleeve, thereby preventing the strips from contacting the rotating inner surface of the sleeve and possibly disintegrating into undesirably small pieces.

The drive means which causes rotation of the cutter head assembly includes a first lugged timing belt 360 (FIGS. 13, 14) trained over the outer periphery of the cutter head assembly. More specifically, timing belt 360, which is provided with lugs 366 (FIG. 13), is trained over central member 316 such that the lugs engage the teeth 320 of the central member.

FIG. 12 shows timing belt 360 in a channel formed between outer members 314*a*, 314*b* such that it does not contact or interfere with idler rollers 304 as the cutter assembly is rotated. At its other end, belt 360 is trained over a drive pulley 362 (FIG. 13), which is driven by a second endless timing belt 364. As shown in FIG. 13, an electric motor or other power means drives belt 364, idler pulley 362 and belt 360 and, through this power train, rotates the cutter head assembly.

Method of Operation—Second Embodiment

The operation of the second embodiment just described is similar to the operation of the first embodiment. One difference of the embodiment of FIGS. 12–16 is that the cutter head assembly is driven by a drive belt which engages the toothed central member of the jacket, thereby eliminating the need for drive ring 230 (FIG. 9), large bearing 242, 243 and associated components of the first embodiment. The cutter head assembly itself requires no bearings which must be replaced periodically due to wear at appreciable expense. Although bearings 334*a*, 334*b* and 344 are load bearing members that must be replaced periodically, they are relatively inexpensive components which individually are subject to relatively low operational stresses and therefore require replacement relatively infrequently.

The idler and thrust rollers are configured and mounted in a manner which facilitates easy removal and installation of the cutter head assembly. Once fasteners 356 are removed, each associated idler and thrust roller pair can be disengaged from the cutter head assembly. With these support rollers so disengaged, the cutter head assembly can be removed and, if desired, the jacket unfastened from the sleeve for repair or replacement of components of the sleeve, jacket or cutting element.

Figure 17:
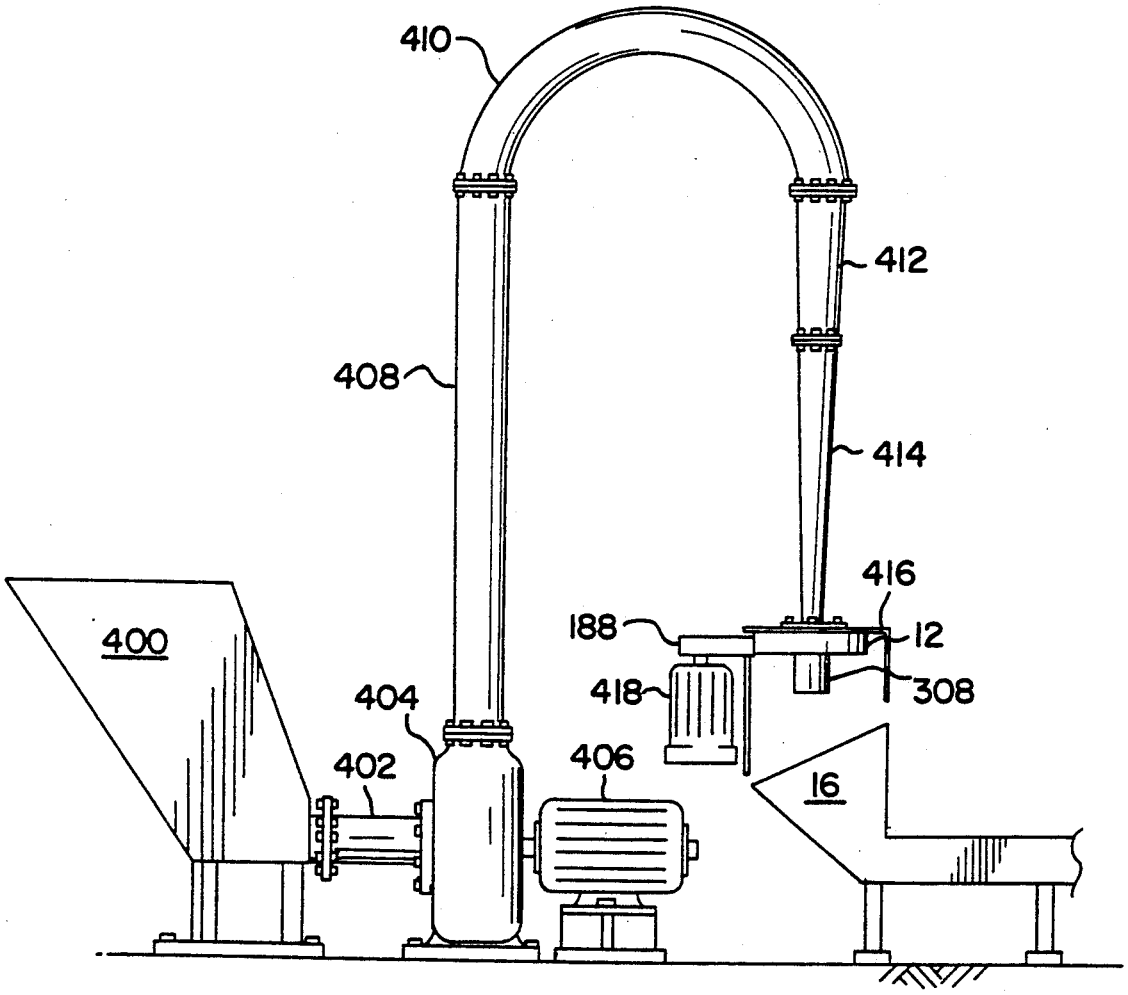
FIG. 17 is a side view of a third embodiment of the food processing apparatus of the present invention.
Figure 18:
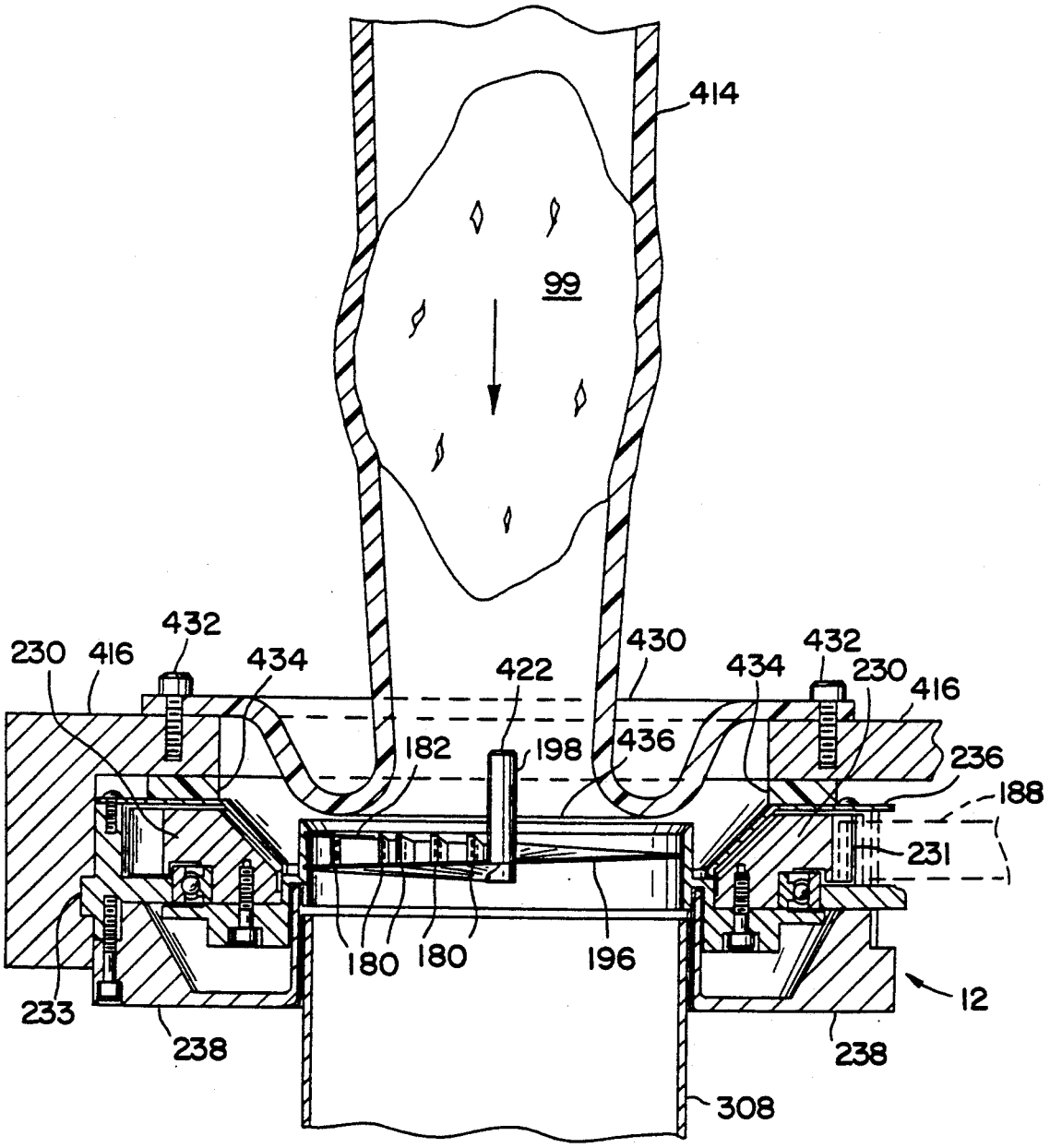
FIG. 18 is a sectional view of a rotary cutting apparatus mounted on a frame with a delivery and discharge tube used in a third embodiment of the food processing apparatus of the present invention.

Detailed Description of Third Embodiment Shown in FIGS. 17–18

Referring to FIG. 17, the potatoes are placed in a water filled supply tank 400. The water acts as a fluid transport media for the potatoes. The supply tank 400 is connected by means of a tubular connector 402 to the inlet of a centrifugal food pump 404. The centrifugal food pump 404 is driven by a suitable means such as an electric motor 406. The centrifugal food pump 404 draws the fluid transport media and the potatoes from the supply tank 400. The outlet of the centrifugal food pump 404 connects to a transport tube 408. This transport tube 408 is typically six inches in diameter.

The supply tank 400 and the centrifugal food pump 404 can be located remotely from the rotary cutting assembly 12 of the present embodiment of the invention. Various elbows and other supply tubes 410 are used to connect the transport tube 408 to a rigid tapered member 412 which reduces the diameter of the delivery system from approximately six inches in diameter at the inlet of the rigid tapered member 412 to four inches in diameter at the outlet of the rigid tapered member 412. The outlet of the rigid tapered member 412 is connected to an elastomeric tapered member 414. The elastomeric tapered member 414 is, in the preferred embodiment, typically cast from a polyurethene material. This cast tapered elastomeric member 414 has an inlet opening of approximately four inches in diameter and an outlet opening of approximately two inches in diameter. The inlet opening corresponds to the diameter of the largest potato to be sliced and the outlet diameter corresponds to the smallest diameter of potato to be sliced. It has been found, however, that potatoes smaller in diameter than the outlet end of the tapered elastic member 414 may be successfully sliced. This is because the smaller potatoes agglomerate and act as a larger potato. The outlet end of the tapered delivery tube 414 has a bell shaped flange 430 which can be seen in FIG. 18 which is attached to an opening in a frame 416 by means of suitable fasteners 432.

The rotary cutting assembly 12 is releasably attached to the frame 416 as will be explained below. A stationary discharge tube 308 is centrally located to the rotary cutting assembly 12. A receiving bin 16 is provided below the discharge tube 308 to collect the water and the cut potato product. Subsequent apparatus (not shown) separate the cut potato product the water and recirculates the water back to the supply tank 400. The use of the supply tank 400 and the centrifugal food pump 404 to hydraulically transport the potatoes eliminates the need to use a trough shaker or other singulator device as described in the description of the first embodiment.

In referring to FIG. 17 it should be noted that the potatoes are fed vertically downward from the tapered elastic member to the rotary cutting assembly. This arrangement has been found to have several advantages. The force of gravity assists the movement of the potatoes. The cut potato product as it exits the discharge tube falls under the force of gravity and the water into the collection bin. This reduces the damage to the cut product. It should be noted, however that the elastic member and the rotary cutting head assembly may be position at any angle and may be horizontal as shown in the first and second embodiment of the invention.

Referring now to FIG. 18, the lower end of the tapered elastomeric member 414 is shown in cross section. The lower end of the tapered elastomeric member 414 has a bell shaped flange 430 which is rigidly mounted to frame 416. The tapered elastic member 414 may have a constant wall thickness or, as in the preferred embodiment, have a wall thickness which varies from five-eighths of an inch at the entrance end to three-eighths of an inch at the exit end.

The rotary cutting assembly 12 cuts the potatoes advanced through it into helical strips by action of a plurality of concentrically spaced scoring blades or knives 180 and a slicing blade 182 (FIG. 6). Referring back now to FIGS. 6–9, the rotary cutting assembly 12 includes a cutting element 190, a ring-like holder 192 for mounting the cutting element at its periphery and a housing 194 within which the holder/cutting element combination can rotate. Cutting element 190 principally comprises a helically shaped plate 196 welded about a central tube 198. On a front surface 200 of the plate 196 are welded the scoring knives or blades 180 which are spaced apart radially from the central tube 198 and extend substantially parallel thereto for concentrically scoring a potato as it is advanced towards the front surface. The blades 180 are desirably disposed on the plate 196 in an alternating, staggered arrangement defining at least two radially extending rows. This arrangement minimizes frictional engagement between the potato and the blades by reducing the compression of the potato in the regions being cut. The blades 180 are bevelled on their outer sides 202 (FIG. 7) to form cutting edges 203 on their outer leading edges, the compression stress induced in the potato by the penetration of the blades 180 being relieved by expansion of the potato towards its periphery.

The plate 196 has a leading edge portion 204 (FIG. 6) defining the radially extending slicing blade 182 that slices the face of a potato scored by the scoring blades 180. The leading edge portion 204 is bent or inclined approximately three degrees relative to the projected surface of the plate 196 in a direction away from its trailing edge 205 (that is, in the direction towards an advancing potato) for a width of about 0.3 inches, as shown by the bend line 207 in FIG. 7. The slicing blade 206 is bevelled on its rear surface 208 opposite front surface 200 to form a knife edge 209 (see FIG. 8).

The central tube 198 (FIG. 9) terminates in a plane perpendicular to its axis and is bevelled at a front end 210 thereof to define a cutting edge 212 along its inner periphery. The cutting edge 212 cuts cores from potatoes advancing into the rotary cutting assembly 12, which cores then pass through tube 198 to the collection bin 16 (FIG. 17). The front end 210 of tube 198 is desirably swaged in so that the cutting edge 212 defines a cutting diameter less than the nominal inside diameter of the tube 198 so the cores cut by the cutting edge may more easily slide through the tube to the collection bin 16. The tube 198 typically has an outside diameter of approximately three-eighths of an inch and an inside diameter of approximately one fourth of an inch in diameter. The tube 198 extends approximately five-eighths of an inch above the surface of plate 196 which insures that the tube 198 extends into the area of the tapered elastic tube 414. A further improvement of placing serrated teeth 422 (FIG. 18) on the cutting edge 212 has been found to reduce the chance of fracturing the potato as the potato impacts the tube 198.

Referring now to FIGS. 6 and 9, the leading edge of the cutting element holder 192 is formed with a bevel 218. The inner peripheral surface 220 of the holder 192 is formed with a helical groove 222 that begins at the bevel 218 and which corresponds to the pitch of the helical plate 196 at its periphery so that the plate can be threadedly received by the holder 192. The threading of plate 196 into and out of the holder 192 is facilitated by providing at least one hole 224 in the plate spaced radially from its center. A tool 226 having a suitable projecting pin 227 and a hole 228, such as are shown in FIG. 6, can then be engaged in hole 224 and with the hole in tube 198 to enable application of a torque to the plate 196 by which it can be threaded into or out of the holder 192. The groove 222 into which the helical plate 196 threads is just slightly longer than one full turn so that the plate 196, when fully threaded in, is locked against further rotation relative to the holder.

The holder 192 and the cutting element 190 are rotatably mounted in the rotary cutting assembly 12 (FIG. 9) which includes a housing 194 including a front guard portion 236 and a rear guard portion 238 between which is mounted a frame ring 232 by screws 239, 241.

The housing 194 is fixedly mounted in the apparatus by means to be described while the holder and cutting element 190 rotate relative thereto. Secured to an outer flange 248 of the holder 192 by screws 246 is a drive ring 230 having gear teeth 231 formed on the periphery thereof. The ring 230 is provided with a circumferential groove 243 for receiving a sealed circular bearing 242, the outer race 244 of which engages the frame ring 232. The bearing 242 thus permits relative rotational movement between the drive ring 230 and the frame ring 232. The toothed drive ring 230 is rotatably driven by the drive gear 188 (FIG. 18) when the rotary cutting assembly 12 is assembled to the frame 416. The rotational movement of the drive ring 230 is transmitted to the holder 192, and thus to the cutting element 190. The frame ring has a peripheral protrusion 233 thereon, the function of which will be described.

The rotary cutting assembly 12 is releasably secured to the frame 416 by an overcenter clamp assembly 250 (FIG. 10) which is attached to the frame 416 and engages the peripheral protrusion 233 on the frame ring 238. As shown in FIG. 18, the drive gear 188 meshes with the gear teeth 231 on the drive ring 230 when the rotary cutting assembly is mounted to the frame 416.

A seal 434 is placed between the front guard 236 of the rotary cutting assembly 12 and the frame 416 to prevent fluid leakage between the rotary cutting assembly 12 and the frame 416. Seal 434 completely blocks all fluid flow between the rotary cutting assembly 12 and the frame 416 or in an alternate embodiment may be open to allow fluid to escape.

A secondary purpose of seal 434 is to act as a spacer to ensure that the exit end 434 of the tapered elastic member 414 is as close as possible to the cutting element 190. It is preferable that the potato is always engaged by either the center tube 198 or the tapered elastic member 414 or more preferably both. This requires that the exit end 436 of the tapered elastic member 414 be within at least five-eighths of an inch to the plate 196, more preferably three-eights of an inch and most preferably within one-eighth of an inch of the plate 196. This arrangement of the spacing will insure that the center tube projects into the opening of the exit end 436 of the tapered elastic member 414.

The holes 224 (FIG. 6) may be increased in diameter or in number to allow a portion of the water to escape through the blade assembly 190. This still allows most of the water to pass between the leading edge 209 and the trailing edge 205 (FIG. 8) of the cutting blade. This assists in transporting the cut potato material and insures that no cut material blocks the cutting blade.

Method of Operation–Third Embodiment

In the third embodiment of the invention, the speed of the cutting element 190 is adjustable to between 2000 revolutions per minute to 10,000 revolutions per minute. A preferred embodiment rotates the cutting element at a speed of 6000 revolutions per minute. The pump 404 transfers the water and the potatoes through the supply tube 408 at a rate of 2000 linear feet per minute. The fluid pressure in a free flow condition (that is without potatoes present) is adjustable between 4–20 pounds per square inch and more preferable between 6–9 pounds per square inch. This pressure converts to a fluid flow having a volume of 500–600 gallons per minute. The hydraulic feed system of the present invention automatically centers the potato on the cutting head for slicing because the outlet end of the tapered elastic member 414 is rigidly attached to the frame 416 in axial alignment with the centerline of the rotary cutting assembly 12. It is also believed that the water flowing about the potato as it is being cut prevents the potato from rotating due to the reaction to the rotary cutting assembly 12. The hydraulic pressure forces the potato against the rotary cutting assembly such that the entire potato is cut.

The potato 99, as it reaches the elastomeric member 414, expands the elastomeric member 414 as the potato 99 travels toward the exit end as shown in FIG. 18. This decreases the velocity of the potato, but increases the water pressure to the range of 15–25 pounds per square inch. Water pressures as high as 40 pounds per square inch have been encountered with extremely large potatoes without adverse effects. Thus the potato is forced evenly and gently onto the central tube 198 of the rotary cutter assembly 12. The central tube 198 and the scoring knives 180 also decelerate the potato before the slicing blade 190 cuts the potato. The potato 99 continues to be forced against the cutting blade 190 by the force of the water behind it. The total force to slice the potato is provided by the slicing blade assembly 190 and not by the transport mechanism. No external mechanical devices touch the potato thus eliminating any damage to the outside of the potato.

As the cutting blade 190 rotates, each incoming potato is scored along concentric lines by scoring knives 180 and sliced by slicing blade 182 producing helical or spiral potato strips of varying diameters. The thickness and width dimensions of the helical strips are dependent upon the radial spacing of the paths of rotation of scoring blades 180 and the spacing between slicing blade 182 and trailing edge 205 (FIG. 8). After being cut, the helical potato strips are conveyed away from the rotary cutting assembly 12 by stationary discharge tube 308 for further processing.

It has also been found that preheating the potato to a core temperature of 130 degrees fahrenheit assists in high speed cutting without shattering the potatoes.

It will be apparent that the present embodiment of the invention accurately aligns the longitudinal center axis of potatoes having widely varying diameters with the longitudinal center axis of the rotating cutting blade 190. Furthermore, this longitudinal alignment is maintained as the potato moves longitudinally into cutting engagement with the cutting blade. As a result, helical strips are produced having excellent thickness uniformity and structural integrity. These advantages are attained in a high production context, even when using smaller potatoes.

Having described and illustrated the principals of our invention in an illustrated embodiment, it should be apparent to those skilled in the art that the invention can be modified in arrangement and detail without departing from such principals. Although the invention has been described in relationship with a rotary cutting assembly to produce helical cut potato products it is to be understood that any rotary or reciprocating cutter head will function as well and should be considered to fall within the range of equivalents anticipated by this application. Accordingly, we claim all modifications coming within the scope and spirit of the following claims.

I claim:

1. An apparatus for cutting a food product comprising:

a means to combine the food product with a fluid media;

a means to hydraulically transport the food product and the fluid media;

a tapered elastic tubular member for receiving the food product and the fluid media, said tapered elastic tubular member being sized to facilitate centering of the food product; and a rotating cutting head assembly located adjacent an outlet end of said tubular member and adapted to slice the food product into strips.

2. An apparatus for cutting a food product as recited in claim 1 further including a frame for supporting said tapered elastic member and said cutting assembly.

3. An apparatus for cutting a food product as recited in claim 1 wherein the fluid media is water.

4. An apparatus for cutting a food product as recited in claim 1 wherein the tapered elastic tubular member is a cast polyurethane material.

5. An apparatus for cutting a food product as recited in claim 4 wherein the polyurethane tapered elastic tubular member has a wall thickness between about three-eighths of an inch and about five-eighths of an inch in thickness.

6. An apparatus for cutting a food product as recited in claim 1 wherein the means to hydraulically transport the food product and the fluid media includes a centrifugal food pump.

7. An apparatus for cutting a food product as recited in claim 6 wherein the centrifugal food pump produces a fluid pressure of about 4 to 20 pounds per square inch when no food product is present.

8. An apparatus for cutting a food product as recited in claim 7 wherein the centrifugal food pump produces a fluid pressure of between about 6 to 9 pounds per square inch when no food product is present.

9. An apparatus for cutting a food product as recited in claim 1 wherein the cutting head assembly includes a means to core the food product, a means to score the food product, and a means to slice the food product.

10. An apparatus for cutting food product as recited in claim 9 wherein the means to slice the food product is a knife on a helical plate.

11. An apparatus for cutting a food product as recited in claim 10 wherein the means to score the food product is a plurality of upstanding knife blades attached to the helical plate.

12. An apparatus for cutting a food product as recited in claim 11 wherein the means to core the potato is an upstanding tubular member centrally located on the helical plate.

13. An apparatus for cutting a food product as recited in claim 11 wherein the tubular coring member is located inside the exit end of the tapered tubular member.

14. An apparatus for cutting a food product as recited in claim 2 wherein the frame supports the tapered elastic tubular member in a vertical position and further supports the cutting head co-axially beneath the tapered elastic tubular member.

15. An apparatus for cutting a food product comprising;

a bin for receiving the food product and water;

a means to pump the food product and water thereby transporting the food product under water pressure;

a tapered tubular elastic delivery tube for receiving the food product and water;

said delivery tube having an entrance end and an exit end, said exit end being smaller in diameter than said entrance end; and a rotary cutter assembly mounted adjacent to the exit end of the delivery tube to slice the food product.

16. An apparatus for cutting a food products as recited in claim 15 wherein the delivery tube is made from a polyurethane material.

17. An apparatus for cutting a food product as recited in claim 16 wherein the thickness of the polyurethane material is between about three-eights of an inch and about five-eights of an inch in thickness.

18. An apparatus for cutting a food product as recited in claim 15 wherein the exit end of said tapered tubular delivery tube includes a bell shaped flange formed thereon.

19. An apparatus for cutting a food product as recited in claim 18 wherein said bell shaped flange positions the exit end of said delivery tube within about five-eights of an inch of said cylindrical cutter assembly.

20. An apparatus for cutting a food products as recited in claim 15 wherein the cutter assembly includes a means to core the food product, a means to score the food product and a means to slice the food product.

21. An apparatus to cut a food product as recited in claim 20 wherein the means to slice the food product is a knife on the leading edge of a helical plate.

22. An apparatus for cutting a food product as recited in claim 21 wherein the means to core the food product is a tubular member having a serrated leading edge.

23. An apparatus for cutting a food product as recited in claim 20 wherein said tubular member extends into an opening in the exit end of said delivery tube.

24. An apparatus for cutting a food product as recited in claim 22 wherein the means to score the food product is a plurality of upstanding knives attached to the helical plate.

25. An apparatus for cutting a food product comprising:

a means to combine the food product with a fluid transport media;

a means to pump the food product and the fluid transport media;

a means to guide the food product and fluid transport media;

a tapered tubular elastic delivery tube having a longitudinal axis, said delivery tube connected to said guide means;

said delivery tube having an entrance end larger in diameter than the diameter of the food product and an exit end smaller in diameter than the diameter of the food product;

said delivery tube confining fluid flow therein, whereby the full force of said fluid pressure is exerted against said product and said delivery tube expanding about the product and decelerating the product as the product moves along the delivery tube;

a substantially cylindrical cutter head assembly having a cutting end, a discharge end, a knife assembly including a coring tube, a slicing knife and a plurality of scoring knives, said knife assembly mounted on the cutting end of said cutter head assembly for slicing the food product;

a frame;

a means to mount the exit end of the delivery tube to the frame;

a means to mount the cutter head assembly to said frame such that the cutting end is adjacent the exit end of the delivery tube and the coring tube is in line with the longitudinal axis of the delivery tube;

a means to rotate the knife assembly; and a stationary discharge tube positioned co-axially inside said cutter head assembly adjacent said discharge end, whereby said knife assembly rotates relative to said stationary discharge tube as said discharge tube receives and discharges the food product sliced by said slicing knife.

26. An apparatus for cutting a food product as recited in claim 25 wherein the means to rotate the knife assembly rotates the knife assembly in a plane perpendicular to the longitudinal axis of the delivery tube.

27. An apparatus for cutting a food product as recited in claim 26 wherein the longitudinal axis of the delivery tube is substantially vertical and the delivery tube is disposed above the knife assembly.

28. An apparatus for cutting a food product comprising:

a bin for receiving a food product and water;

a means to hydraulically transport the food product and water;

a tapered tubular elastic delivery tube for receiving the food product and water;

said delivery tube having a longitudinal axis with an entrance opening and an exit opening;

a rotary cutter assembly having a longitudinal axis and rotating in a plane perpendicular to said longitudinal axis of said cutter assembly;

said longitudinal axis of said delivery tube in line with said longitudinal axis of said cutter assembly; and a tubular member on said longitudinal axis of said cutter assembly protruding into the exit opening of said delivery tube.

29. An apparatus for cutting potatoes into helical strips comprising:

hydraulic conveying means for transporting potatoes sequentially in a fluid media to a cutting location; and a rotating cutting head assembly located at said cutting location, and having a disk-like cutting element adapted to slice the potatoes into helical strips;

said hydraulic conveying means further serving to convey the helical strips away from the cutting location after slicing.

* * * * *